US010765156B2

(12) United States Patent
Myerscough et al.

(10) Patent No.: US 10,765,156 B2
(45) Date of Patent: Sep. 8, 2020

(54) LOWER BACK ENTRY BODY SUIT

(71) Applicant: Ocean Rodeo Sports Inc., Victoria (CA)

(72) Inventors: Richard K. Myerscough, Victoria (CA); Ross D. Harrington, Victoria (CA)

(73) Assignee: OCEAN RODEO SPORTS INC., Vitoria, British (CA)

( * ) Notice: Subject to any disclaimer, the term of this patent is extended or adjusted under 35 U.S.C. 154(b) by 0 days.

(21) Appl. No.: 16/310,180

(22) PCT Filed: Jun. 1, 2017

(86) PCT No.: PCT/CA2017/050668
§ 371 (c)(1),
(2) Date: Dec. 14, 2018

(87) PCT Pub. No.: WO2017/214715
PCT Pub. Date: Dec. 21, 2017

(65) Prior Publication Data

US 2019/0174844 A1 Jun. 13, 2019

Related U.S. Application Data

(60) Provisional application No. 62/350,818, filed on Jun. 16, 2016.

(51) Int. Cl.
*A41D 13/02* (2006.01)
*A41B 9/00* (2006.01)

(52) U.S. Cl.
CPC ..... *A41D 13/02* (2013.01); *A41B 9/00* (2013.01); *A41B 2300/322* (2013.01);
(Continued)

(58) Field of Classification Search
CPC ..... A41D 13/02; A41B 9/00
(Continued)

(56) References Cited

U.S. PATENT DOCUMENTS 1,783,538 A 12/1930 Herskowitz
2,849,717 A 9/1958 Klotz
(Continued)

FOREIGN PATENT DOCUMENTS

CA 2 620 258 A1 3/2007
CA 2 802 998 A1 1/2012
(Continued)

OTHER PUBLICATIONS

International Search Report Corresponding to PCT/CA2017/050668 dated Aug. 24, 2017.
(Continued)

*Primary Examiner* — Gloria M Hale
(74) *Attorney, Agent, or Firm* — Davis & Bujold PLLC; Michael J. Bujold

(57) ABSTRACT

A lower back entry body suit consists of a one piece body having a front, a back, a torso covering upper portion and a lower portion that extends from waist to ankle dividing to define a first leg and a second leg. An access entry is provided into the body suit extending part way up the first leg, across the back, and part way down the second leg. This is the only access entry location on the body for the user to don or doff the body suit.

7 Claims, 6 Drawing Sheets

(52) U.S. Cl.
CPC .... *A41B 2400/44* (2013.01); *A41D 2300/322* (2013.01); *A41D 2400/44* (2013.01); *A41D 2600/10* (2013.01); *A41D 2600/102* (2013.01)

(58) Field of Classification Search
USPC ..... 2/456, 60, 79, 81–83, 2.15, 2.7
See application file for complete search history.

(56) References Cited

U.S. PATENT DOCUMENTS 5,940,879 A * 8/1999 Whitehouse ..... A41D 13/012 2/2.15
6,477,711 B1 11/2002 Freeman et al.
2002/0010988 A1* 1/2002 Cretinon ..... A43C 1/04 24/713.8
2003/0140391 A1* 7/2003 Richards ..... A41D 13/0005 2/67
2007/0186326 A1* 8/2007 Myerscough ..... A41D 13/012 2/69
2010/0212087 A1* 8/2010 Leib ..... G16H 40/20 5/81.1 R
2013/0086723 A1* 4/2013 Myerscough ..... B63C 11/04 2/2.16
2013/0086817 A1* 4/2013 Myerscough ..... A43B 3/00 36/114
2019/0174844 A1* 6/2019 Myerscough ..... A41D 13/02

FOREIGN PATENT DOCUMENTS

CA 2 840 241 A1 1/2013
CA 2 783 803 A1 1/2014

OTHER PUBLICATIONS

Written Opinion Corresponding to PCT/CA2017/050668 dated Aug. 24, 2017.

* cited by examiner

LOWER BACK ENTRY BODY SUIT

FIELD

There is described a body suit that was originally designed as an immersion suit for water activities. It has become apparent that, if made out of suitable materials, the suit would also be suitable for dry suit undergarments and similar one piece garments such as snowmobile, motorcycle and ski suits.

BACKGROUND

A common problem encountered with one piece body suits is difficulty donning and doffing the suit as well as the bulk and location of the zipper restricting mobility.

SUMMARY

There is provided a lower back entry body suit which consists of a one piece body having a front, a back, a torso covering upper portion and a lower portion that extends from waist to ankle dividing to define a first leg and a second leg. An access entry is provided into the body suit extending part way up the first leg, across the back, and part way down the second leg. This is the only access entry location on the body for the user to don or doff the body suit.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

A lower back entry body suit will now be described with reference to FIG. 1 through 5.

Figure 1:
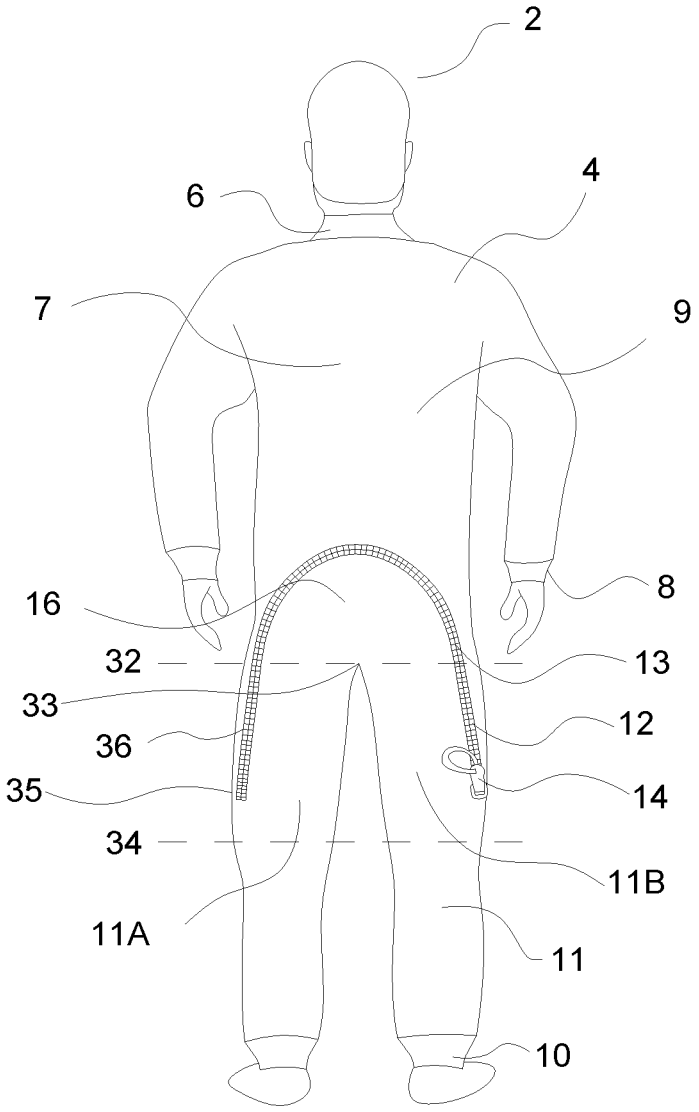
FIG. 1 is a rear elevation view of a lower back entry dry suit.
Figure 2:
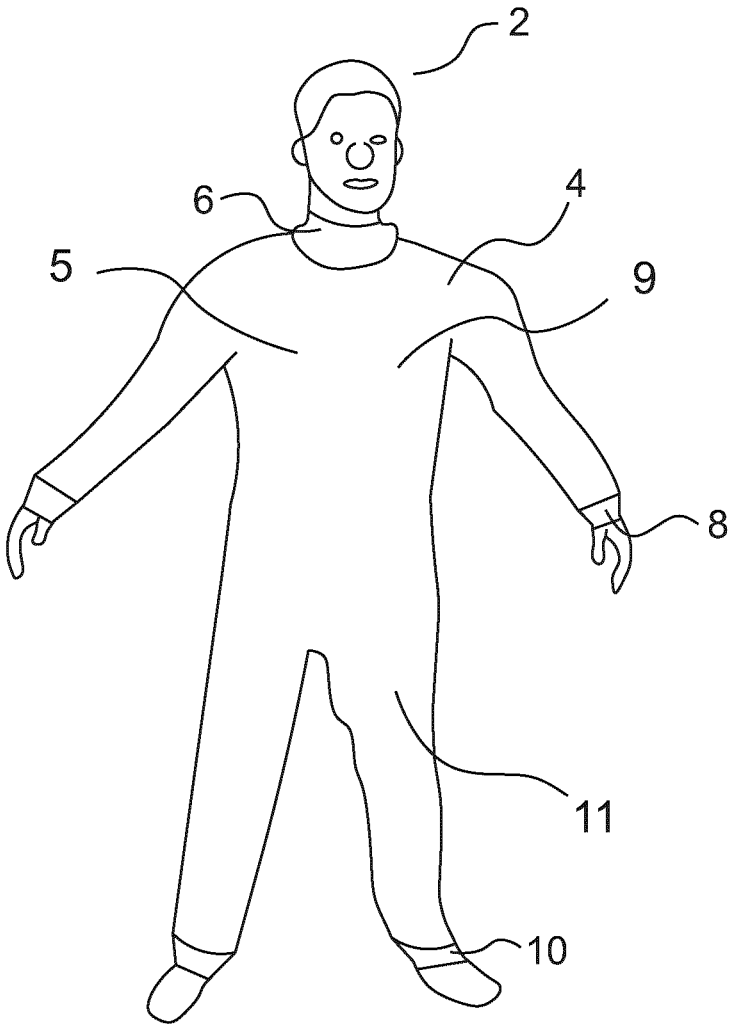
FIG. 2 is a front elevation view of the lower back entry dry suit illustrated in FIG. 1.

Structure and Relationship of Parts:

Referring to FIG. 1 and FIG. 2, of a one piece body 4 having a front 5, a back 7, a torso covering upper portion 9 and a lower portion 11 that extends from waist to ankle dividing to define a first leg 11A and a second leg 11B. Referring to FIG. 1, an access entry 13 is provided into body suit 4 extending part way up first leg 11A, across back 7, and part way down second leg 11B. Access entry 13 is the only access location on one piece body 4 for the user to don or doff the body suit. There will now be described the lower back entry body suit, where one piece body 4 is in the form of a dry suit.

Referring to FIG. 2, a user 2 is shown wearing dry suit 4. When the body suit is a dry suit, there are provided a neck seal 6, wrist seals 8 and ankle seals 10.

Referring to FIG. 1, for other uses, access entry 13 may not have a closure or may have buttons, snaps or forms of closure that are not water proof. When used as a dry suit 4, a water proof closure is essential. The closure illustrated is a dry zipper 12 disposed in an inverted U shape over the lower back and upper rear leg region 16 on the dry suit 4 with a dry zipper slider 14 that allows for opening and closing of dry zipper 12.

In order to better explain the preferred positioning of dry zipper 12, a broken line 32 has been placed at the bottom of a crotch 33 and a broken line 34 has been at knee joint 35 representing. Broken line 34 represents an axis of rotation of the knee. It is preferred that dry zipper 12 does not extend to or below line 34, the axis of rotation of the knee. If dry zipper 12 were to extend below line 34, there would potentially be discomfort in knee joint 35. It is preferred that the section of the dry zipper 36 that is located between line 34 and line 32 is straight.

Figure 3:
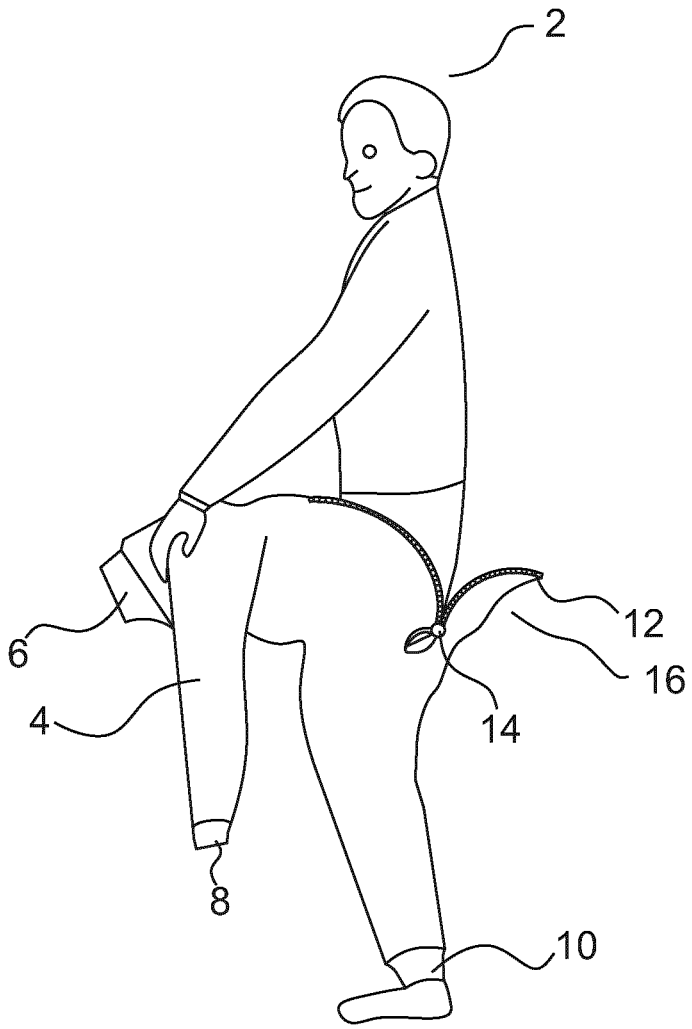
FIG. 3 is a side elevation view of the lower back entry dry suit illustrated in FIG. 1, with the user's legs inside the suit.

Referring to FIG. 3, the user 2 is depicted as having partially donned dry suit 4 by entering through the opened dry zipper 12, with his legs inside the dry suit and his feet pushed through the ankle seals 10.

Figure 4:
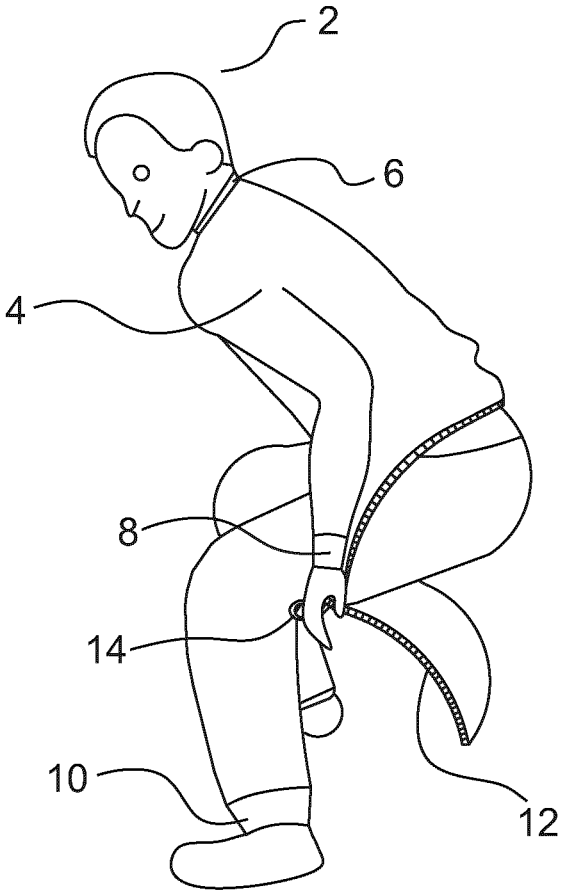
FIG. 4 is a side elevation view of the lower back entry dry suit illustrated in FIG. 1, with the user inside the suit, preparing the close the dry zipper.

Referring to FIG. 4, the user 2 has further donned dry suit 4 with hands pushed through the wrist seals 8 and head pushed through the neck seal 6 and his hand preparing to pull the dry zipper slider 14 to close the dry zipper 12.

Figure 5:
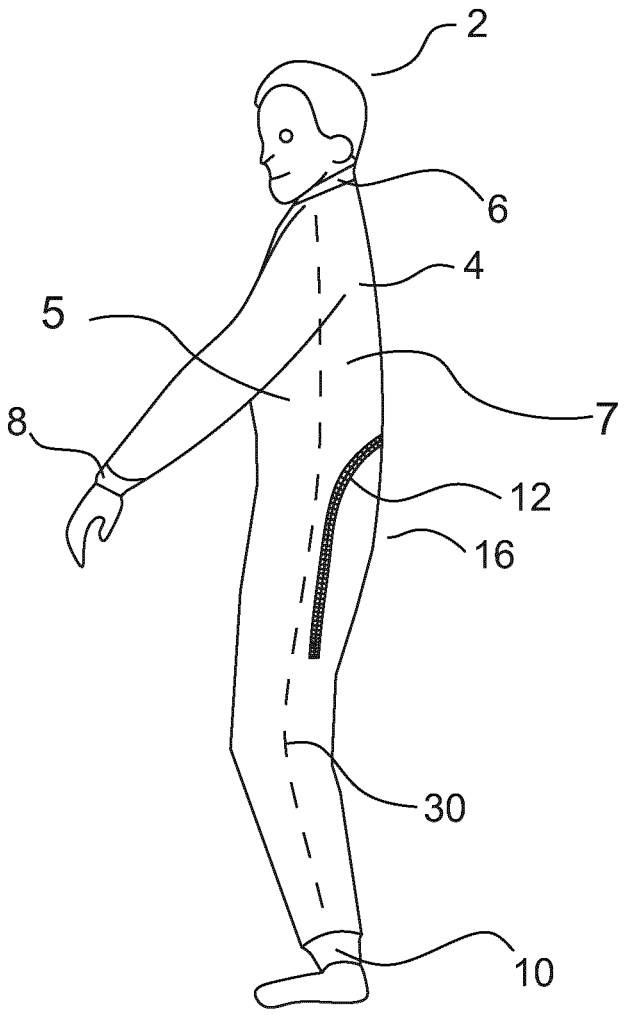
FIG. 5 is a side elevation view of the lower back entry dry suit illustrated in FIG. 1, with the user inside the suit and the dry zipper closed.

Referring to FIG. 5, a user 2 has donned a dry suit 4 and closed dry zipper 12. Broken line 30 represents an out-seam line which is the separation between front 5 and back 7 of dry suit 4. Dry zipper 12 does not pass over out-seam line 30 onto front 5 of dry suit 12.

Operation:

Referring to FIG. 1, access entry 13 extends part way up first leg 11A, across back 7, and part way down second leg 11B. When used as a dry suit, access entry 13 is closed with a dry zipper 12. Referring to FIG. 3, access entry 13 allows user 2 easy access into dry suit 4 by first placing his legs through the opened inverted U shaped dry zipper 12, located on the lower back and upper rear leg region 16. This can be done in a sitting or standing position. Referring to FIG. 4, once user 2 has pushed his feet through the ankle seals 10 he then bends forwards and goes hand first through the opened inverted U shaped dry zipper 12, located on the lower back and upper rear leg region 16, and pushes his hands through the wrist seals 8 and then pushes his head through the neck seal 6. As the user 2 sits up or straightens up his body, dry suit 4 slides into position covering the users body. The user 2 can now easily grasp the dry zipper slider 14 and close the dry zipper 12.

As previously described, it is preferred that dry zipper 12 stops above line 34, which represents the axis of rotation of knee joint 35. If dry zipper 12 were to extend below line 34, there would potentially be discomfort in knee joint 35. As the position of the dry zipper is away from the user's upper body, arms and knees it does not impede movement or mobility and it allows user 2 to wear accessories, backpacks, air tanks, etc. without interference from the dry zipper 12.

Figure 6:
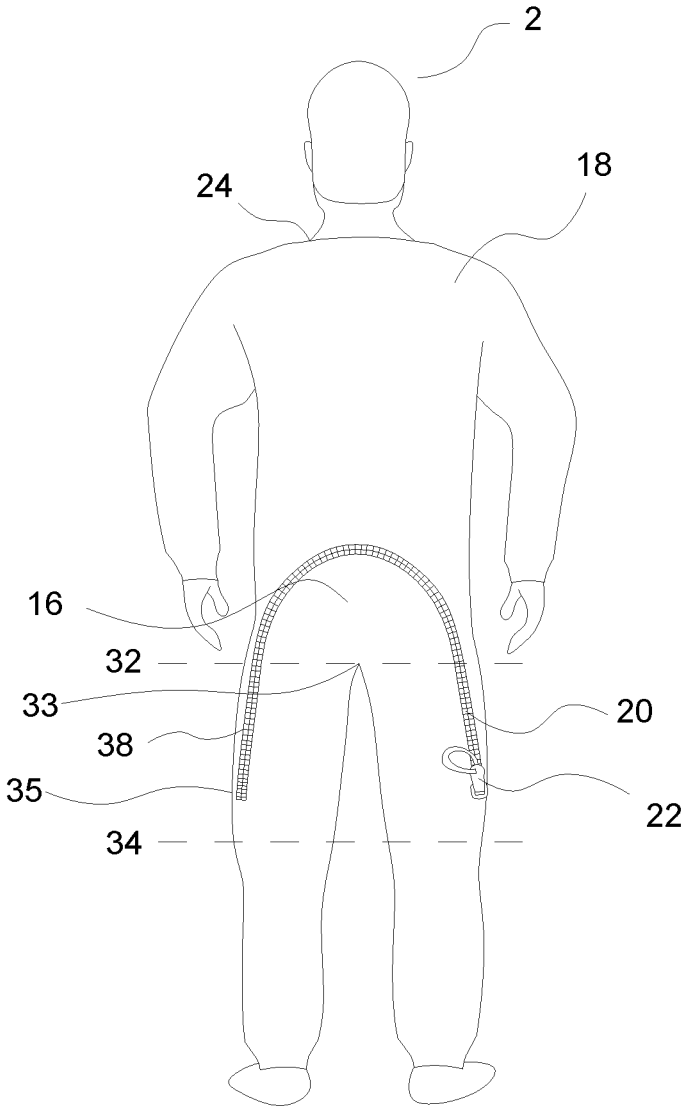
FIG. 6 is a rear elevation view of a variation where the suit is a dry suit undergarment.

Variations:

Referring to FIG. 6, a variation is illustrated in which the one piece body is a dry suit undergarment 18 that has a closure in the form of a zipper 20. Zipper 20 is disposed in an inverted U shape over the lower back and upper rear leg region 16 on dry suit undergarment 18 with a zipper slider 22 that allows for opening and closing zipper 20. As previously described in relation to dry suit 4, line 32 is at the bottom of crotch 33 and line 34 is at the axis of rotation of knee joint 35. It is preferred that zipper 20 does not extend below line 34, the axis of rotation of the knee. It is preferred that the section of the zipper 38 that is located between line 34 and line 32 is straight. Dry suit undergarment 18 is worn in the same manner as has been described above in relation to dry suit 4.

There has previously been described use as a dry suit 4. It will be appreciated that any immersion suit for water sports can be made with dry suit seals in the regions of the neck, wrists and ankles, identified in the Figures as neck seal 6, wrist seals 8 and ankle seals 10. It will also be appreciated that soft socks can be used in place of ankle seals 10.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with a purposive construction of the claims in view of the description as a whole.

What is claimed is:

1. A lower back entry body suit comprising:

a one piece body having a front, a back, a torso covering upper portion and a lower portion that extends from waist to ankle and is divided to define a first leg and a second leg, and a sole access entry into the body suit extending part way up the first leg, across the back at or above the waist, and part way down the second leg.

2. The lower back entry body suit of claim 1, wherein the access entry terminates above a knee joint region on both the first leg and the second leg.

3. The lower back entry body suit of claim 2, wherein a closure closes the access entry.

4. The lower back entry body suit of claim 3, wherein the closure is a zipper.

5. The lower back entry body suit of claim 4, wherein the zipper is a water-proof dry zipper.

6. The lower back entry body suit of claim 1, wherein the one piece body is a dry suit undergarment.

7. The lower back entry body suit of claim 5, wherein the one piece body is a dry suit.

* * * * *